US010995429B2

(12) United States Patent
Abels et al.

(10) Patent No.: US 10,995,429 B2
(45) Date of Patent: May 4, 2021

(54) METHOD FOR PRODUCING CARBON FIBERS FROM CELLULOSE FIBERS TREATED WITH SULFONIC ACID SALTS

(71) Applicant: Deutsche Institute fur Textil-und Faserforschung, Denkendorf (DE)

(72) Inventors: Falko Abels, Roemerberg (DE); Martin Merger, Frankenthal (DE); Tomasz Cwik, Mannheim (DE); Klemens Massonne, Bad Duerkheim (DE); Johanna Sporl, Stuttgart (DE); Frank Hermanutz, Leonberg (DE); Michael R. Buchmeiser, Remshalden (DE)

(73) Assignee: DEUTSCHE INSTITUTE FURTEXTIL-UND FASERFORSCHUNG DENKENDORF, Denkendorf (DE)

( * ) Notice: Subject to any disclaimer, the term of this patent is extended or adjusted under 35 U.S.C. 154(b) by 351 days.

(21) Appl. No.: 16/077,356

(22) PCT Filed: Feb. 1, 2017

(86) PCT No.: PCT/EP2017/052079

§ 371 (c)(1),
(2) Date: Aug. 10, 2018

(87) PCT Pub. No.: WO2017/137285

PCT Pub. Date: Aug. 17, 2017

(65) Prior Publication Data

US 2019/0062954 A1 Feb. 28, 2019

(30) Foreign Application Priority Data

Feb. 11, 2016 (EP) ..... 16155261

(51) Int. Cl.

| | |
|---|---|
| ***D01F 9/16*** | (2006.01) |
| ***D01F 2/00*** | (2006.01) |
| ***D01F 2/02*** | (2006.01) |
| ***D01F 11/02*** | (2006.01) |
| ***D06M 13/256*** | (2006.01) |
| ***D06M 101/06*** | (2006.01) |

(52) U.S. Cl.

CPC ..... *D01F 9/16* (2013.01); *D01F 2/00* (2013.01); *D01F 2/02* (2013.01); *D01F 11/02* (2013.01); *D06M 13/256* (2013.01); *D06M 2101/06* (2013.01)

(58) Field of Classification Search

CPC ..... D01F 9/16; D01F 2/00; D01F 2/02; D01F 11/02; D01F 11/00; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D01F 13/00; D06M 2101/06; D06M 13/256

See application file for complete search history.

(56) References Cited

U.S. PATENT DOCUMENTS

| | | | | |
|---|---|---|---|---|
| 3,179,605 | A | 3/1965 | Ohsol | |
| 4,723,959 | A | 2/1988 | Miyamichi et al. | |
| 2005/0022310 | A1* | 2/2005 | Renfrew | D01F 11/02 8/115.51 |
| 2014/0308862 | A1 | 10/2014 | Heinzman et al. | |
| 2017/0081787 | A1* | 3/2017 | Son | D01D 10/06 |

FOREIGN PATENT DOCUMENTS

| | | | | |
|---|---|---|---|---|
| DE | 2500307 | A1 | 11/1975 | |
| WO | 2015173243 | A1 | 11/2015 | |
| WO | WO 2015/173243 | A1 * | 11/2015 | D01F 9/16 |

* cited by examiner

*Primary Examiner* — Daniel C. McCracken

(74) *Attorney, Agent, or Firm* — Fay Sharp LLP

(57) ABSTRACT

The invention relates to a process for producing carbon fibers from cellulosic fibers, characterized in that cellulosic fibers, which contain a sulfonic acid salt of formula (I), wherein $R^1$ represents a hydrocarbon group and $K^+$ represents a cation, are converted into carbon fibers.

13 Claims, No Drawings

METHOD FOR PRODUCING CARBON FIBERS FROM CELLULOSE FIBERS TREATED WITH SULFONIC ACID SALTS

The invention relates to a process for the production of carbon fibers from cellulosic fibers, characterized in that cellulosic fibers, which contain a sulfonic acid salt of formula (I),

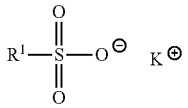

wherein R1 represents a hydrocarbon group and K+ represents a cation, are converted into carbon fibers.

Carbon fibers can be made by pyrolysis of polyacrylonitrile fibers or cellulosic fibers. There are natural cellulosic fibers, e.g., cotton, and synthetically produced cellulosic fibers obtained by digestion of wood. Because of the large and cheap raw material base, synthetically produced cellulosic fibers are particularly interesting starting materials for the production of carbon fibers.

EP-A 1669480 describes the production of carbon fibers from cellulosic fibers. The cellulosic fibers used are impregnated with a polysiloxane.

DE-A 1951020 and DE-A 1955474 describe the carbonization of cellulosic fibers. Viscose fibers are used as cellulosic fibers. The cellulosic fibers are treated with an additive which increases the strength. Inter alia, ammonium thiosulfate urea, a salt of the ammonium cation ($NH_4^+$) and the anion of the formula $H_2N—C(=S)—NH—SO^-_3$, as an additive which increases the strength.

PCT/EP2015/060479 (PF 76706) describes a process for the production of carbon fibers from cellulosic fibers in which the cellulosic fibers obtained from a spinning bath are not dried prior to the subsequent finishing with additives. The viscose fibers contain ammonium compounds as an additive for increasing the strength. Ammonium imidosulphonate thiourea is also used as the ammonium compound.

In processes for producing carbon fibers, the carbon yield should be as high as possible, that is, the carbon of the starting fiber is converted as completely as possible into the carbon fiber. In previously known processes for the production of carbon fibers from cellulosic fibers, the carbon yield is not yet satisfactory. Part of the carbon of the cellulose is lost by decomposition into ultimately carbon monoxide and carbon dioxide. Also, the mechanical properties of the carbon fibers obtained from cellulosic fibers, e.g., the elasticity, should be improved.

The object of the present invention was therefore to provide an improved process for the production of carbon fibers from cellulosic fibers.

Accordingly, the process defined above was found.

The sulfonic acid salts of formula I

The cellulosic fibers which are converted to carbon fibers contain a sulfonic acid salt of formula I above.

The term "sulfonic acid salt" also includes mixtures of sulfonic acid salts.

Preferably, $R^1$ represents a hydrocarbon group having 1 to 20 C atoms, particularly preferably a hydrocarbon group having 2 to 15 C atoms, and very particularly preferably a hydrocarbon group having 5 to 15 C atoms.

In a particularly preferred embodiment, $R^1$ is an aromatic group or contains an aromatic group. Thus, $R^1$ may be an optionally substituted aryl group, e.g., an optionally substituted phenyl, diphenyl or naphthyl group, or $R^1$ may be an alkaryl group, e.g. an optionally substituted phenyl, diphenyl or naphthyl group linked via an alkylene group to the sulfur atom.

In a particularly preferred embodiment, $R^1$ is a group of formula III

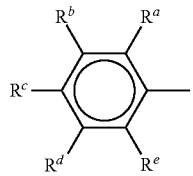

or IV

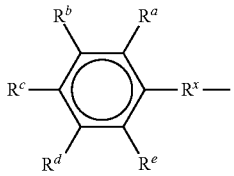

wherein $R^a$ to $R^e$ independently represent an H atom or a C1 to C4 alkyl group and $R^x$ represents a C1 to C4 alkylene group.

In particular, at least 3 of the radicals $R^a$ to $R^e$ represent an A atom.

In a very particularly preferred embodiment, R1 represents a phenyl, tolyl or xylyl group, in particular a tolyl group.

The cation in formula I may be any inorganic or organic cation, e.g., a metal cation or a cationic organic ring system of carbon atoms and optionally heteroatoms such as N, O or S.

Preferably, it was a cation of formula II

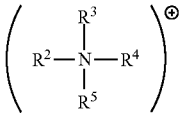

wherein $R^2$ to $R^5$ independently represent an H atom or an organic group having 1 to 20 C atoms.

In particular, R2 to R5 independently represent an H atom or an alkyl group having 1 to 4 C atoms. In particular, at least two of the radicals R2 to R5 represent an H atom.

Very particularly preferably, the cation is ammonium, that is, $(NH^4)^+$.

The sulfonic acid salt of formula I preferably has a solubility in water of at least 10 parts by weight, particularly preferably of at least 20 parts by weight of sulfonic acid salt per 100 parts by weight of water under normal conditions (20° C., 1 bar).

In a very particularly preferred embodiment, the sulfonic acid salt is ammonium tosylate.

The cellulosic fiber preferably contains the sulfonic acid salt in such an amount that the sulfur content caused by the sulfonic acid salt is 0.1 to 3 wt %, based on the total weight of the dried cellulosic fiber; particularly preferably the content of sulfur caused by the sulfonic acid salt is at least 0.2 wt %, in particular at least 0.5 wt %, based on the total weight of the dried cellulosic fiber.

Particularly preferably, the sulfur content caused by the sulfonic acid salt is in the range of 0.5 to 2 wt %, based on the total weight of the dried cellulosic fiber.

The Cellulosic Fibers

Herein, cellulosic fibers are understood to mean fibers which consist of more than 60 wt %, in particular more than 80 wt %, particularly preferably more than 90 wt % of cellulose or modified cellulose.

In a particular embodiment, the cellulosic fibers consist of more than 98 wt %, very particularly preferably 100 wt % of cellulose or modified cellulose.

Modified cellulose is understood to mean cellulose in which hydroxyl groups are etherified or esterified, e.g., it may be cellulose acetate, cellulose formate, cellulose propionate, cellulose carbamate or cellulose allophanate.

The cellulosic fibers are preferably fibers which contain more than 60 wt %, in particular more than 80 wt %, particularly preferably more than 90 wt % and in the particularly preferred embodiments more than 98 wt % or 100 wt % cellulose.

The cellulosic fibers may be natural cellulosic fibers, e.g. cotton fibers, or synthetic cellulosic fibers. Synthetic cellulosic fibers are fibers in which cellulose obtained from any of the cellulose-containing organic materials is converted into the fiber form synthetically, i.e., by a technical process. Such synthetic cellulosic fibers are in particular: viscose fibers, produced by the viscose process, Lyocell® fibers, produced from a spinning solution containing NMMO (N-methylmorpholine-N-oxide) as a solvent and cellulosic fibers, which are obtained from spinning solutions containing ionic liquid as a solvent, as described, e.g., in WO 2007/076979.

In a preferred embodiment, the cellulosic fibers have a water content of more than 20 parts by weight of water, in particular more than 30 parts by weight of water, particularly preferably more than 50 parts by weight of water, very particularly preferably more than 70 parts by weight of water per 100 parts by weight of cellulosic fiber.

In general, however, the water content is not higher than 500, in particular not higher than 300 parts by weight of water per 100 parts by weight of cellulosic fiber.

The cellulosic fiber having the above water content can be easily obtained by, for example, immersing a dried cellulosic fiber in water. Both natural cellulosic fibers and synthetic cellulosic fibers are suitable for this purpose.

In a preferred embodiment, synthetic cellulosic fibers are used.

In a preferred embodiment, synthetic cellulosic fibers are used, which were prepared immediately before by a spinning process.

The cellulosic fibers are then preferably obtained by spinning the cellulosic fibers from a spinning solution and then washing said cellulosic fibers with water.

In the above spinning process, a spin bath is produced by dissolving cellulose in a solvent. From this spinning bath, the cellulosic fiber is obtained by coagulation of the cellulose in the form of a fiber. Thereafter, the obtained cellulosic fibers are washed with water to remove adhering solvent or adhering additives from the spinning bath.

The contact with water is preferably carried out so that the cellulosic fiber absorbs water in the desired amount indicated above. For this purpose, the cellulosic fiber can be immersed in water for a sufficient time or be passed through a sufficiently long water bath in a continuous process.

In the production of the cellulosic fibers preferably no process measures for drying take place. The cellulosic fiber obtained in the spinning process is washed with water without prior drying and then, of course again without prior drying, brought into contact with the solution of the additive. It is therefore a so-called "never dried" cellulosic fiber which has the above content of water.

Additivating Cellulosic Fibers

The cellulosic fibers, preferably the aqueous cellulosic fibers (never dried), are contacted with a solution of the above sulfonic acid salt of formula I.

Preferably, it is a solution of the sulfonic acid salts in a hydrophilic solvent, in particular in water or in a hydrophilic organic solvent, e.g., alcohols or ethers, or mixtures thereof. Particularly preferred hydrophilic solvents are water or mixtures of water with other hydrophilic organic solvents which are fully miscible with water in which case, in a preferred embodiment, the water content in the solvent mixture is at least 50 wt %.

In particular, it is a solution of the sulfonic acid salts of the formula I in water.

The concentration of the sulfonic acid salts in the solution and the contact times of the fiber with the solution are selected so as to obtain the above content of sulfonic acid salt in the dried fiber. For this purpose, the cellulosic fiber can be immersed in the solution for a sufficient time or passed through a sufficiently long solution bath in a continuous process.

In a preferred embodiment, the cellulosic fiber is continuously passed through the solution of sulfonic acid salts. The content of sulfonic acid salts in the solution is, e.g., 0.05 to 5 mol/per liter of solution, preferably 0.1 mol to 2 mol/per liter of solution.

The contact time of the cellulosic fiber with the solution of the sulfonic acid salts is preferably at least 0.5 seconds, particularly preferably at least 2 and very particularly preferably at least 10 seconds. Generally, the contact time is not longer than 100 seconds, preferably not longer than 30 seconds.

The cellulosic fiber can also be finished with other additives. For this purpose, the solution of the sulfonic acid salt may contain such other additives; however, the cellulosic fiber can also be brought into contact with solutions of other additives in further process steps.

Particularly suitable other additives are compounds which have a solubility in water of at least 10 parts by weight, preferably of at least 20 parts by weight, in particular of at least 30 parts by weight per 100 parts by weight of water under normal conditions (20° C., 1 bar). The additives are preferably low molecular weight compounds which have a maximum molecular weight of 1000 g/mol, particularly preferably not more than 500 g/mol, in particular not more than 300 g/mol. Suitable other additives include, e.g., salts or acids, e.g., inorganic salts, inorganic acids, organic salts or organic acids, such as carboxylic acids or phosphonic acids. Salts include, e.g., phosphates, hydrogen phosphates, phosphites, hydrogen phosphites, sulfates or sulfites, or chlorides. In the cations of the above, may be, e.g., metal cations, preferably alkali metal cations such as $Na^+$ or $K^+$, or ammonium ($NH_4^+$).

In a preferred embodiment, the cellulosic fiber contains predominantly or exclusively sulfonic acid salts of formula I as an additive. In particular, more than 50 wt %, particularly preferably more than 80 wt %, very particularly preferably more than 90 wt % of the total amount of additives used for finishing the cellulosic fiber is sulfonic acid salts of the formula I. In a very particularly preferred embodiment, the additives used for finishing the carbon fiber are exclusively sulfonic acid salts of formula I.

The production of the cellulosic fiber in the spinning process and subsequent further processing by washing the cellulosic fiber and contacting the cellulosic fiber with the solution of the additives are preferably components of a continuous overall process. In this case, after its production, the cellulosic fiber is generally fed to the individual steps of further processing via movable rollers.

Finally, excess solvent can be removed from the solution of the additives by squeezing and the cellulosic fiber can be rolled up.

Finally, the additivated cellulosic fiber can be dried, e.g., at temperatures of 50 to 300° C. Drying of this type is recommended when the additivated cellulose fiber is first to be stored or transported before being converted into a carbon fiber.

Finally, the additivated cellulosic fiber is converted into a carbon fiber by pyrolysis.

The pyrolysis is generally carried out at temperatures of 500 to 1600° C. It can be carried out, e.g., under air or under inert gas, e.g., nitrogen or helium. Preferably, it is carried out under an inert gas.

Before the pyrolysis, the cellulosic fiber may be dried. For already dried and stored cellulosic fibers, the drying may optionally be repeated.

A multi-stage process may be suitable in which the cellulosic fiber is dried at temperatures in the range of 50 to 300° C., and then the pyrolysis is carried out at temperatures in the range of 500 to 1600° C., preferably 700 to 1500° C.

Both during drying and pyrolysis, the temperature may be increased stepwise or continuously.

Suitable drying, for example, may take place in two or more stages, for example at 50 to 100° C. in a first stage and at 100 to 200° C. in a second stage. The contact time in the individual stages can be, for example, 5 to 300 seconds in each case and 10 to 500 seconds in total during the drying.

A suitable pyrolysis, for example, may be carried out in which the temperature is continuously increased, e.g., starting from 200° C. until finally reaching 1600 or 1400 or 1200° C. The temperature increase can take place, for example, at 1 to 20 Kelvin/minute.

The cellulosic fiber should preferably be exposed to a temperature in the range of 900 to 1600° C. during a time of 10 to 60 minutes.

The carbon yield in the pyrolysis is generally 20 to 95 wt %; that is, the carbon fiber contains 20 to 95 weight percent of the carbon contained in the cellulosic fiber. The carbon yield is in particular from 70 to 95, particularly preferably from 70 to 90, very particularly preferably from 70 to 85 wt %.

By the process according to the invention an increased carbon yield is made possible. The obtained carbon fiber has very good mechanical properties, in particular good strength and elasticity.

EXAMPLES

Cellulosic Fiber

A synthetic, tear-resistant cellulosic fiber used for the production of car tires is used as the cellulosic fiber in the example and the comparative examples. Such cellulosic fibers are known as tire cord fibers. The cellulosic fiber used was made from cellulose dissolved in an ionic liquid. The cellulosic fiber was obtained by coagulation of the cellulose from the spinning bath and not dried since its production. It had a water content greater than 70 parts by weight of water per 100 parts by weight of cellulose, hence the term "never-dried tire cord fiber".

The finishing and drying of the cellulosic fiber takes place in a continuous process on godets. Godets are rollers that allow the continuous flow of fiber along the system. There are 4 of these godets used. Between the first and the second godet, the fiber is loaded with the additives via an immersion bath. Between the third and fourth godet there is a hot air duct, in which drying takes place. At the end, a tension controlled winder winds up the finished and dried fiber material.

The carbonization of the obtained dried cellulosic fiber was carried out in Example 1 and Comparative Example 1 also in a continuous process; in Comparative Examples 2 and 3, it was carried out batchwise

Example 1

The never-dried tire cord fiber was wound in 2 turns around godet 1 (room temperature, 6.5 m/min) and pulled through a 0.3 molar aqueous solution of ammonium tosylate and wound in 6 turns around godet 2 (room temperature, 6.5 m/min) and then in 7 turns around godet 3 (80° C., 6.5 m/min). The fiber was wound through a heating duct (120° C., length: 1.5 m) on godet 4 (room temperature, 6.5 m/min) and then onto a bobbin.

The sulfur content of the dried fiber was 1 wt %.

The cellulosic fiber thus produced was continuously derivatized and stabilized under inert gas. The residence times were 13.8 min at 200° C., 27.7 min at 210° C. and 13.8 min at 240° C. Accordingly, the total residence time in the stabilization was 55.2 min. The thread tension was 0.34 cN/tex.

The obtained stabilized fiber was then carbonized continuously under inert gas. For this purpose, the fiber was subjected to tensile stress. The thread tension was 2.6 cN/tex. The residence times were 1.58 min at 310 and 510° C., 4.74 min at 750° C., 1.58 min at 971° C. and 4.74 min at 1400° C. for a total of 12.65 min.

Comparative Example 1

Comparative Example 1 was carried out in exactly the same way as Example 1, except for the following.

The never-dried tire cord fiber was not pulled through a 0.3 molar solution of ammonium tosylate, but through a 1 molar solution of ammonium hydrogen phosphate.

The phosphorus content of the dried fiber was 1 wt %.

Accordingly, the total residence time in the stabilization was 55.2 min. The thread tension was 0.38 cN/tex.

The thread tension in the carbonization was 1.1 cN/tex. As the thread tension was increased, the fiber ripped apart.

Comparative Example 2

Comparative Example 2 was carried out in exactly the same way as Example 1, except for the following.

The never-dried tire cord fiber was not pulled through a 0.3 molar solution of ammonium tosylate, but through a 0.3 molar solution of p-toluenesulfonic acid.

The sulfur content of the dried fiber was 1 wt %.

The cellulosic fiber thus produced was very fragile and brittle. It could not be further processed in a continuous process as it does not withstand any tensile load. The cellulosic fiber was therefore derivatized, stabilized and carbonized in a batch process. The following temperature program was used:

Room temperature (about 21° C.) to 160° C. with a heating rate of 1 Kelvin/min; then at 160° C. for 30 minutes, then from 160° C. to 400° C. at a heating rate of 10 K/min; and finally from 400° C. to 1400° C. with a heating rate of 3.3 Kelvin/min.

Comparative Example 3

Comparative Example 3 was carried out in the same way as Comparative Example 2, except that the never-dried tire cord fiber was not treated with any additive, neither ammonium tosylate nor toluenesulfonic acid, prior to its drying.

For drying the never-dried tire cord fiber was wound in 7 turns around godet 1 (80° C., 6.5 m/min) and through a heating duct (120° C., length:) on godet 2 (room temperature, 6.5 m/min) and then on a bobbin.

Thereafter, the cellulosic fiber was derivatized, stabilized and carbonized in a batch process according to Comparative Example 2.

TABLE 1

Data of the obtained carbon fibers

| Carbon fiber from | Example 1 | Comp. Example 1 | Comp. Example 2 | Comp. Example 3 |
|---|---|---|---|---|
| Additive | Ammonium tosylate | Ammonium dihydrogen-phoshate | p-toluene-sulfonic acid | — |
| DP(EWN)[1] after finishing and drying | 580 | 620 | 65 | 630 |
| Carbonization | continuously | continuously | batchwise | batchwise |
| Carbonization yield (wt %) | 30 | 30 | 29 | 15 |
| Carbon content (wt %) | >97 | 92 | >99 | >99 |
| Textile mechanical properties[2] | | | | |
| Tensile strength [GPa] | 1.6 | 1.0 | 1.0 | n.d.[3] |
| Elongation at break [%] | 2.0 | 2.5 | 2.0 | n.d.[3] |
| Modulus of elasticity [GPa] | 80 | 43 | 39 | n.d.[3] |

[1]DP(EWN): average degree of polymerization, by viscometry (alkaline iron tartrate complex solution)
[2]Average values from 20 single filament measurements
[3]n.d.: not determinable, the fibers are too fragile.

The textile-mechanical properties of the fiber were determined by a tensile test using the instrument "Favimat" from Textechno.

The carbonization yield indicates how much carbon of the cellulose in the cellulosic fiber has been converted to carbon of the carbon fiber.

The carbon content indicates the wt % of carbon in the carbon fiber.

The invention claimed is:

1. A process for the production of carbon fibers from cellulosic fibers, characterized in that cellulosic fibers, which contain a sulfonic acid salt comprised of ammonium tosylate are converted into carbon fibers.

2. The process according to claim 1, characterized in that the sulfonic acid salt has a solubility in water of at least 10 parts by weight per 100 parts by weight of water at (20° C., 1 bar).

3. The process according to claim 2, characterized in that it is a process in which a) cellulosic fibers are produced,
b) said cellulosic fibers are brought into contact with the sulphonic acid salt in the form of ammonium tosylate and then
c) the cellulosic fibers which contain the sulfonic acid salt are converted into carbon fibers.

4. The process according to claim 1, characterized in that the cellulosic fiber contains the sulphonic acid salt in an amount such that the content of sulfur is from 0.1 to 3 wt %, based on the total weight of the dried cellulosic fiber.

5. The process according to claim 4, characterized in that it is a process in which a) cellulosic fibers are produced,
b) said cellulosic fibers are brought into contact with the sulphonic acid salt in the form of ammonium tosylate and then
c) the cellulosic fibers which contain the sulfonic acid salt are converted into carbon fibers.

6. The process according to claim 1, characterized in that it is a process in which a) cellulosic fibers are produced,
b) said cellulosic fibers are brought into contact with the sulphonic acid salt in the form of ammonium tosylate and then
c) the cellulosic fibers which contain the sulfonic acid salt are converted into carbon fibers.

7. The process according to claim 6, characterized in that the cellulosic fibers are obtained in process step a) by spinning the cellulosic fibers from a spinning solution and then washing said cellulosic fibers with water.

8. The process according to claim 7, characterized in that until carrying out process step b), no process measures are carried out for drying the cellulosic fibers.

9. The process claim 6, characterized in that, in process step b), cellulosic fibers which have a water content of more than 20 parts by weight of water per 100 parts by weight of cellulosic fiber are brought into contact with a solution of the sulphonic acid salt.

10. The process according to claim 9, characterized in that until carrying out process step b), no process measures are carried out for drying the cellulosic fibers.

11. The process according to claim 9, characterized in that the cellulosic fibers contain more than 50 parts by weight of water per 100 parts by weight of cellulose.

12. The process according to claim 11, characterized in that until carrying out process step b), no process measures are carried out for drying the cellulosic fibers.

13. The process according to claim 6, characterized in that until carrying out process step b), no process measures are carried out for drying the cellulosic fibers.

* * * * *